United States Patent [19]

Hedstrom et al.

[11] 4,037,895

[45] July 26, 1977

[54] DOCUMENT STORAGE SYSTEM

[75] Inventors: Norman Hedstrom, Worcester; David Wright; Jerome O'Toole, both of Shrewsbury, all of Mass.

[73] Assignee: Wright Line Inc., Worcester, Mass.

[21] Appl. No.: 669,672

[22] Filed: Mar. 23, 1976

[51] Int. Cl.[2] ..... A47B 41/06; A47B 63/00

[52] U.S. Cl. ..... 312/233; 312/231

[58] Field of Search ..... 312/231, 233, 14, 10

[56] References Cited

U.S. PATENT DOCUMENTS

| | | | |
|---|---|---|---|
| 140,979 | 7/1873 | Wilber | 312/233 |
| 561,454 | 6/1896 | Thieler | 312/233 |
| 980,796 | 1/1911 | Koepp | 312/233 |
| 1,120,050 | 12/1914 | Goggin | 312/233 |
| 1,854,721 | 4/1932 | Swain | 312/233 X |
| 2,046,395 | 7/1936 | Manoilovich et al. | 312/233 |
| 2,494,382 | 1/1950 | Faulkner et al. | 312/233 |
| 2,560,721 | 7/1951 | Gibson | 312/233 |
| 2,910,802 | 11/1959 | Garner | 312/233 |
| 3,489,475 | 1/1970 | Boyce et al. | 312/14 X |
| 3,866,993 | 2/1975 | Dean et al. | 312/216 |

*Primary Examiner*—Robert L. Wolfe
*Assistant Examiner*—Victor N. Sakran
*Attorney, Agent, or Firm*—Milton E. Gilbert

[57] ABSTRACT

A cabinet is provided which comprises a pull-out shelf, means for supporting books on the shelf so that they can be opened and read without removing them from the shelf, and means for automatically closing the books at the ends of the shelf when the shelf is pushed back into the cabinet.

8 Claims, 9 Drawing Figures

DOCUMENT STORAGE SYSTEM

This invention relates to document storage systems and more particularly to cabinets for storing reference manuals, catalogs, reports and other bound documents.

Reference manuals, catalogs and the like are commonly stored on shelves and are removed to counters or desks for use. This practice is objectionable where the bound volumes are heavy and the counters or desks are remote from the shelves. Certain volumes, e.g., automotive repair manuals and replacement parts catalogs, are frequently kept on top of counters or the like for ready access, and often the volumes are secured in place to prevent unauthorized removal. This practice is objectionable since bound volumes occupy valuable work space surface. Also the volumes are accessible for inspection by unauthorized persons and are vulnerable to damage by fire.

Accordingly an important object of this invention is to provide a system for storing reference manuals, catalogs and other bound volumes of documents whereby they may be used without need to support them on a desktop or like work surface and can be closed off for fire protection and also to prevent unauthorized access or removal.

Another important object is to provide a storage cabinet for reference books such as manuals, catalogs and the like which comprise a pull-out shelf, and means for securing the books to the shelf so that any one of the books can be opened and read without removing it from the shelf.

Still another object is to provide a storage cabinet having (1) a pull-out shelf for supporting a plurality of reference books so that any one of the books can be opened for study and (2) means for automatically closing any open book when the shelf is pushed back into the cabinet.

Other objects are rendered obvious from the following description.

The foregoing objects are achieved by providing a cabinet with a roll-out shelf unit, a book support carried by the shelf, means on the book support for releasably holding a book, book-closing means carried by the shelf, and means for operating the book-closing means when the shelf unit is pushed into the cabinet.

Other features and many of the attendant advantages of the invention are set forth in or rendered obvious by the following detailed description wherein.

Figure 1:
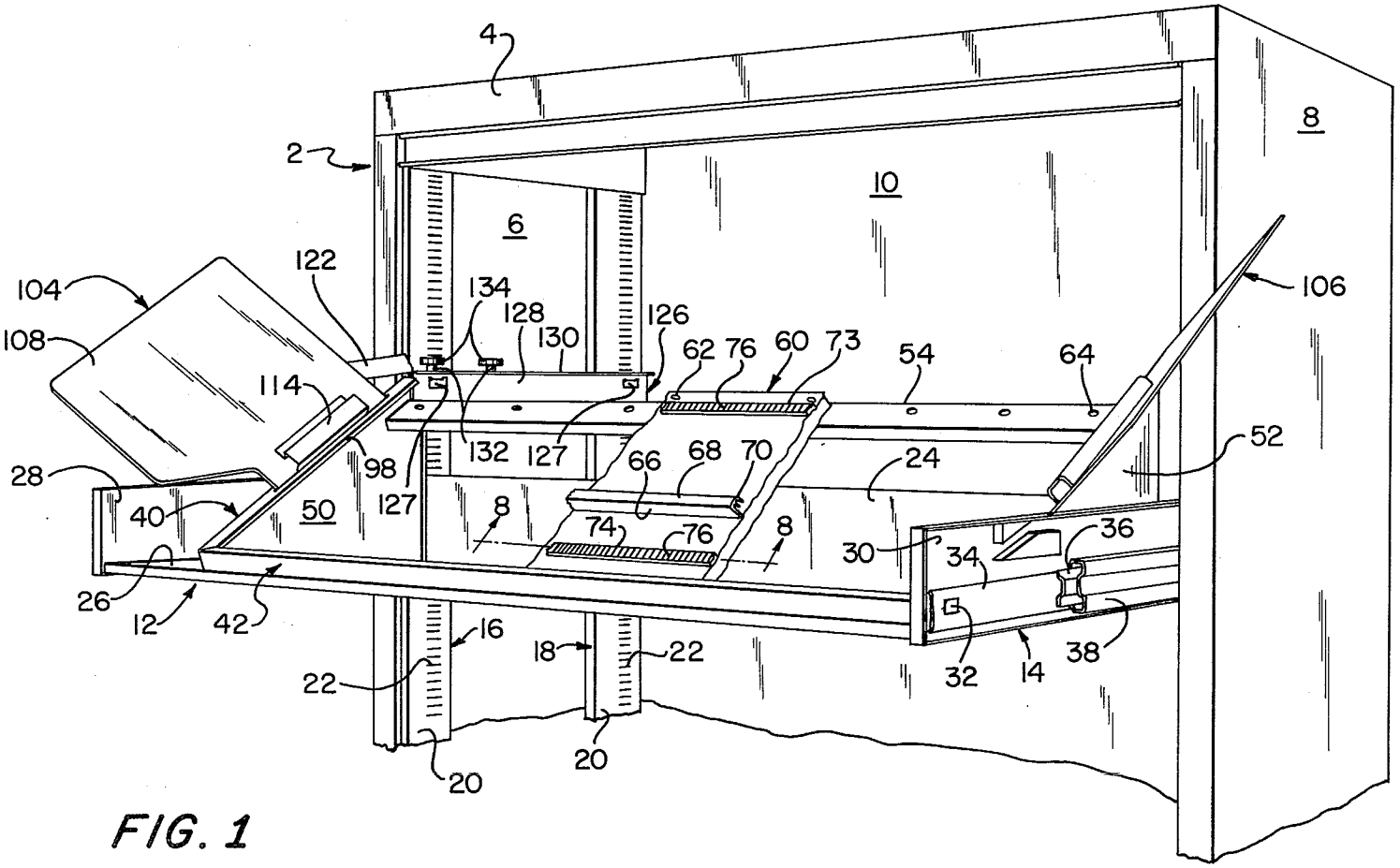
FIG. 1 is a fragmentary perspective view of a cabinet with a shelf unit constructed in accordance with this invention, the shelf unit being in extended or "use" position.
Figure 5:
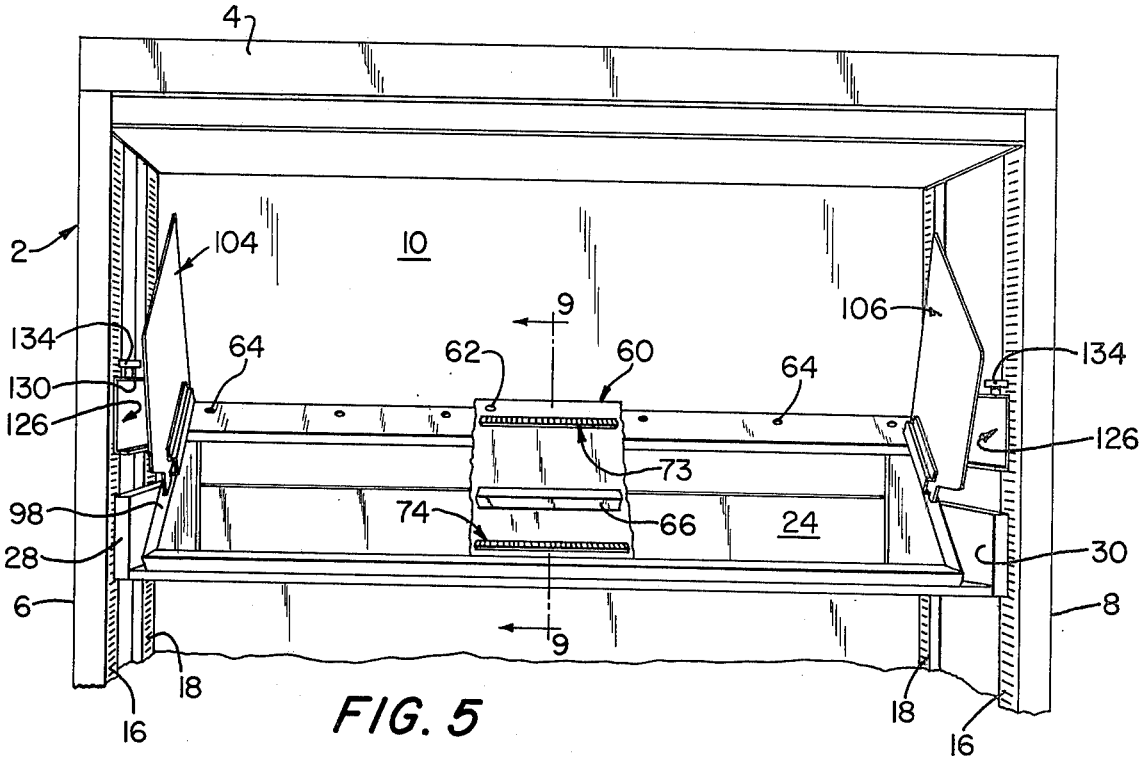
FIG. 5 is a fragmentary front elevation of the same cabinet with the shelf unit in retracted or "store" position.

Turning to the drawings, FIGS. 1 and 5 illustrate an upper portion of a file cabinet 2 incorporating a preferred form of the present invention. The cabinet 2 may be of conventional constructionand consists of a top wall 4, opposite side walls 6 and 8, a rear wall 10 and a bottom wall (not shown) which are interconnected to form an integral structure. The cabinet 2 is adapted to include a tier of pull-out shelves. For convenience of illustration, only one pull-out shelf 12 is shown. However, it is to be appreciated that additional pull-out or stationary shelves may be accommodated by the cabinet. Each pull-out shelf is mounted on a pair of suspension arm units 14. It is to be understood that the suspension arms shown in the drawings are of conventional design. Preferably the suspension arm units 14 are constructed and attached to the pull-out shelf and the cabinet in substantially the same manner as the suspension arm units described and illustrated in U.S. Pat. No. 3,866,993. However, suspension arms of other known design may be used to mount the shelves for pull-out action.

In accordance with the teachings of U.S. Pat. No. 3,866,993, two upright members 16 and 18 are attached to the inner sides of each of the side walls 6 and 8. These upright members 16 and 18 are essentially channel members and comprise body portions 20 which are spaced from the adjacent side wall and are provided with a series of vertically-spaced horizontally elongated slots 22. These slots serve to position the suspension units for the pull-out shelves.

Referring now to FIGS. 1, 2 and 5–7, the pull-out shelf 12 comprises a rear wall 24, a bottom wall 26 and opposite side walls 28 and 30. Each of the side walls 28 and 30 is attached to a suspension arm unit 14. For this purpose, each side wall 28 and 30 is provided with a pair of mounting tabs 32, only one of which is shown. Each of the suspension arm units comprises three telescoping arms 34, 36 and 38 with the arm 34 having a pair of slots to accommodate the tabs 32, whereby the arm 34 is secured to the adjacent side wall of the shelf so that the shelf can move with that arm as the latter telescopes relative to arms 36 and 38. Although not shown, it is to be understood that the arms 34, 36 and 38 are slidably interconnected by ball or roller bearing units which facilitate the required telescoping action. Each of the arms 38 also is provided with a pair of mounting tabs (not shown) for interlocking with the slots 22 in the adjacent uprights 16 and 18, thereby locking the suspension arm 38 against movement relative to the cabinet. Obviously the height of each pull-out shelf 12 can be adjusted by raising or lowering the suspension arm assemblies 14 with respect to the uprights 16 and 18 at each side of the cabinet. This permits a variable number of pull-out shelves to be mounted in the cabinet and also the use of pull-out shelves of different vertical dimensions. Further details of the suspension arm unit 14 and how they are connected to the shelf and cabinet are omitted since they are not essential to an understanding of the invention and are obvious to a person skilled in the art.

Still referring to FIGS. 1, 2 and 5–7, each shelf 12 carries a book support assembly identified generally by the numeral 40. Each book support assembly comprises a first channel member 42 which extends between the side walls 28 and 30. Channel member 42 consists of a relatively wide flange 44 which engages shelf bottom 26, a web section 46 which is disposed at an obtuse angle to the flange 44 and a second flange 48 which extends at approximately a right angle to the web section 46. The opposite ends of channel member 42 are secured to the front ends of a pair of side members 50 and 52 which are essentially triangular in shape (see FIG. 1). Side members 50 and 52 have bottom flanges 53 which are secured to shelf bottom 26 by suitable fasteners (not shown), thereby locking the book support assembly to the shelf. A second channel member 54 extends between and is secured to the side members 50 and 52 adjacent their rear ends. Channel member 54 comprises a flat web section 56 which lies in a plane that extends parallel to the plane of flange 48 of channel member 42. Channel member 54 also is elevated with respect to channel member 42. Channel member 54 serves as a base or rest for a book support plate 60 which is supported by shelf 12. Book support plate 60 is disposed so that its bottom margin extends into the channel formed by the flanges 44 and 48 of channel member 42 and its upper margin rests upon channel member 54. The upper margin of book support plate 60 and the channel member 54 are provided with holes as shown at 62 and 64 whereby the book support plate 60 may be secured to the channel member by means of suitable screws (not shown).

Figure 7:
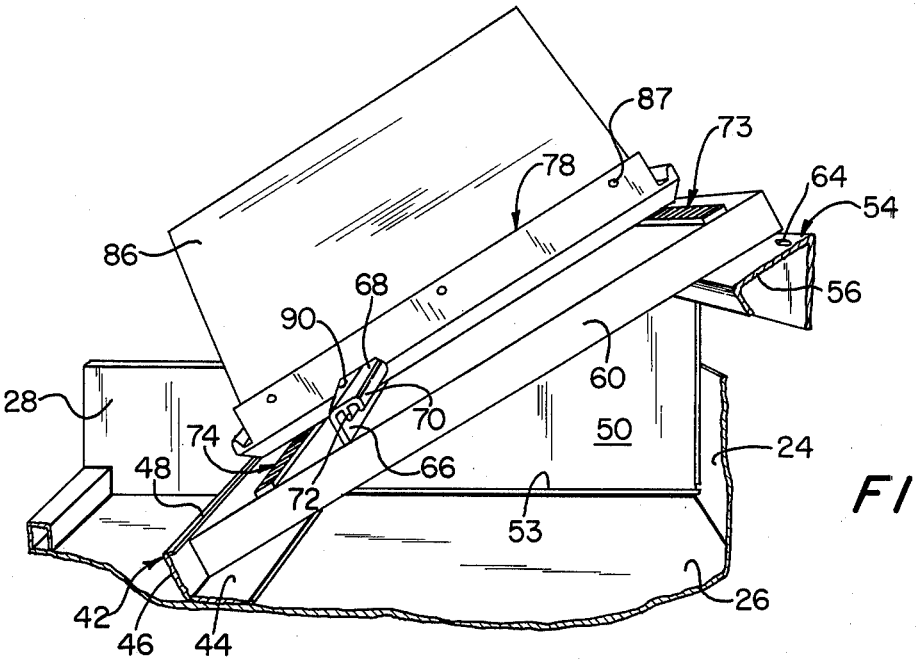
FIG. 7 is a sectional perspective showing how one of the loose-leaf reference books of FIG. 6 is attached to the shelf unit.
Figure 8:
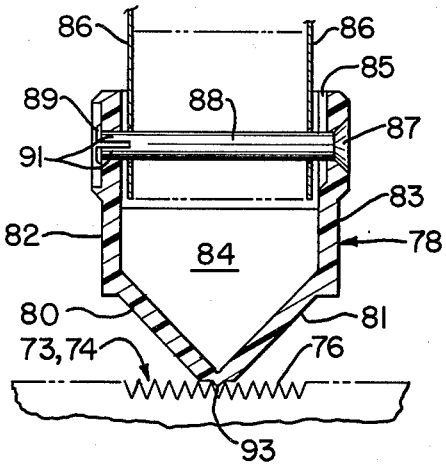
FIG. 8 is a sectional view taken substantially along line 8—8 of FIG. 1 showing a loose leaf binder.
Figure 9:
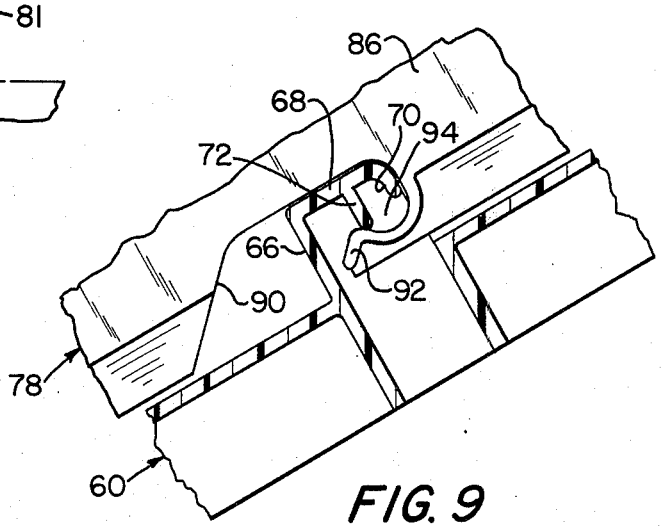
FIG. 9 is a sectional view taken substantially along line 9—9 of FIG. 5.

As seen best in FIGS. 1, 5 and 7, book support plate 60 is provided with an elongate rib 66 located intermediate its upper and lower edges. Rib 66 is provided with a flange 68 which extends substantially parallel to the plane of book support plate 60. A lip 70 is formed at the free end of flange 68 so that the flange and lip cooperate with rib 66 to provide a hook-shaped cross-section. A fin 72 also is formed integral with the underside of flange 68 intermediate rib 66 and lip 70. Additionally book support plate 60 is provided with two additional ribs 73 and 74 which are located adjacent to its upper and lower edges and are serrated due to provision of V-shaped grooves 76. The grooves in rib 73 are aligned with the corresponding grooves in rib 74 and cooperate with rib 66 to secure reference manuals, catalogs and other books comprising suitable loose-leaf holders as hereinafter described.

Figure 6:
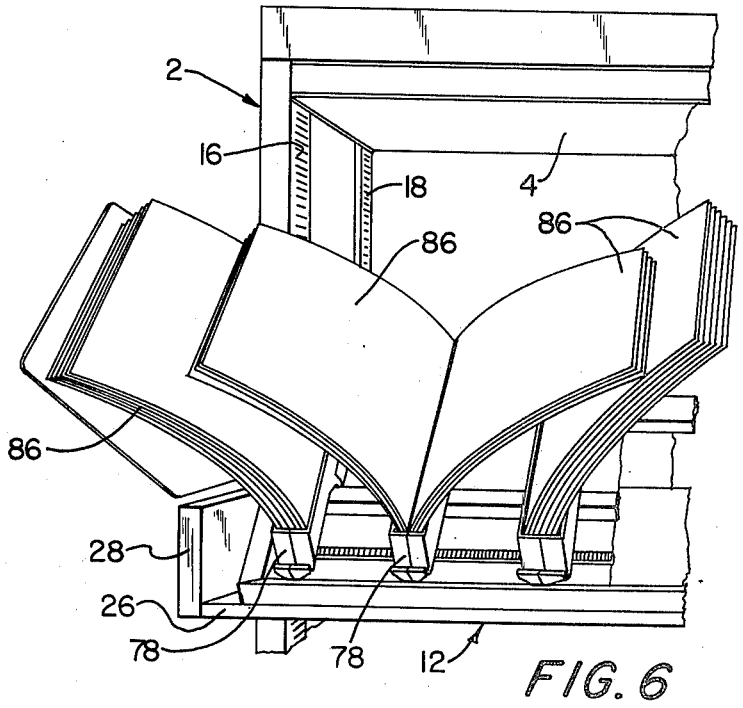
FIG. 6 is a perspective view showing several loose-leaf reference books attached to the shelf unit.

Referring now to FIGS. 6 and 7, several bound volumes are shown attached to the book support plate 60. These volumes consist of loose-leaf cartridge-type binders or holders 78 which are generally the same as the ones disclosed in Modern Office Procedures, Vol. 20, No. 12, page 42, December 1975, and Information And Records Management, Vol. 9, No. 9, page 9, September 1975. The holders 78 are molded of a suitable plastic, e.g. polypropylene, and may be one-piece units or they may be made of two or more parts secured together. Each of the holders has a pair of oppositely inclined side walls 80 and 81, a pair of integral depending limbs 82 and 83 and one or more transversely-extending reinforcing struts 84. Limbs 82 and 83 define a channel 85 for receiving the margins of a plurality of documents or loose-leaves 86. Each holder 78 also includes document binding means in the form of posts 88 which extend across channel 85 through suitable openings in the leaves 86 and are connected to limbs 82 and 83. Binding posts 88 are preferably made of plastic and have a head 87 at one end and a flange 89 at the other end to interlock with limbs 83 and 82 respectively. Also each post is split at its second end so as to form two spring-like resilient sections 91 that can be caused to yield toward one another to permit flange 89 to be released from limb 82. The junction of side walls 80 and 81 of the holder comprises a V-shaped section 93 which is sized to nest in the grooves 76 of ribs 73 and 74.

Additionally each holder 78 is formed with a notch 90 and a hook 92. Notch 90 is sized to accommodate rib 66 and its flange 68 and hook 92 is shaped to provide a reentry portion 94 to accommodate part of flange 68 and lip 70. Hook 92 is sized and shaped so that it will pass between lip 70 and board 60 and make a snap fit with fin 72, whereby holder 78 is releasably locked to book support plate 60. Holder 78 is restrained against lateral movement by interlocking of its V-shaped section 93 with grooves 76 in ribs 73 and 74 and cannot be lifted away from the book support plate 60 by virtue of the interlocking of hook 92 with lip 70 and fin 72. Since book support plate 60 is inclined to the horizontal, gravity tends to urge holder 78 down into engagement with the grooves 76 and also in interlocking engagement with fin 72. Removal of a holder can be achieved only by pressing the holder down against plate 60 and simultaneously urging the holder away from the bottom edge of plate 60. Attachment of a holder is achieved by placing its V-shaped section 93 in aligned grooves 76 in ribs 73 and 74 and sliding the holder downward so that its hook 92 slides under lip 70 and interlocks with fin 72.

As is believed obvious, a number of books comprising binding means as previously described can be supported on plate 60 and any one of the books can be opened for reference purposes in the manner shown in FIG. 6. While the reference books may be opened while the shelf is in its store position, i.e., withdrawn within the cabinet, it is contemplated that the shelf will be pulled out for easier access to the stored books. However, if the books are opened up while the shelf is in its extended or use position, the flexible pages of the end volumes will tend to extend laterally over side walls 28 and 30 of the shelf and in such position, they will hinder pushing the shelf back to its store position and also are likely to be damaged when the shelf is pushed back into the cabinet. The invention overcomes this problem by providing means for automatically causing the pages of the end volumes to be cammed inwardly when the shelf is pushed back into the cabinet. For this purpose each of the side members 50 and 52 is formed with an inturned flange 98 at its upper end. Each of these flanges is also formed with a lip 100 (see FIG. 4). Each flange 98 is also provided with two mutually spaced slots 102 which are elongated lengthwise of the flange. Slots 102 are for use in attaching a pair of book closing members 104 and 106 to side members 50 and 52 respectively. Book closing members 104 and 106 are essentially identical but mirror images of one another. Each of members 104 and 016 consists of a flat plate 108 which is formed along one side with a pair of hook-shaped elements 110 and 112 respectively. Additionally, each plate 108 has secured thereto a channel member 114 which includes a flange 116 that extends between hook-shaped portions 110 and 112 and is bent back on the opposite side of the plate as shown at 118. The bent back portion 118 extends at an obtuse angle to the main portion of flange 116, the latter itself extending at approximately a right angle to the plane of plate 108. Channel member 114 is secured to plate 108 so as to form an integral part thereof. Book closing members 104 and 106 may be made of metal or other material of suitable stiffness, e.g. a reinforced plastic.

Figure 4:
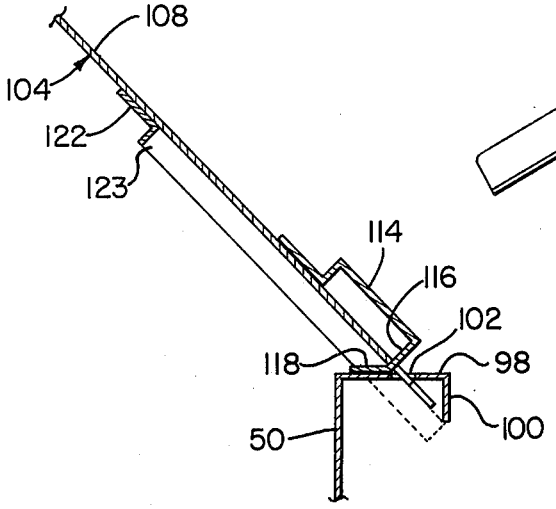
FIG. 4 is a sectional view taken along line 4—4 of FIG. 2.

Hook-shaped sections 110 and 112 are adapted to be inserted into slots 102 and to lock the flange 98. Slots 102 are made relatively wide in comparison to the thickness of plate 108 (see FIG. 4) with the amount of play between them being sufficient to allow the plate to pivot so as to be movable between the vertical position illustrated in FIG. 5 and the slanted position illustrated in FIGS. 1 and 4. Flange 118 of channel member 114 serves as a stop; by virtue of its engagement with flange 98, it determines the angular position of the plate 108 with respect to the side member of which the flange 98 is a part. If desired, hook portions 110 and 112 may be sized so that their bottom edge 120 will engage lip 100 on flange 98 when the book closing member is in its extended (inclined) position (FIG. 4). Book closing members 104 and 106 can assume their inclined positions only when the shelf is pulled out (FIG. 1).

Figure 2:
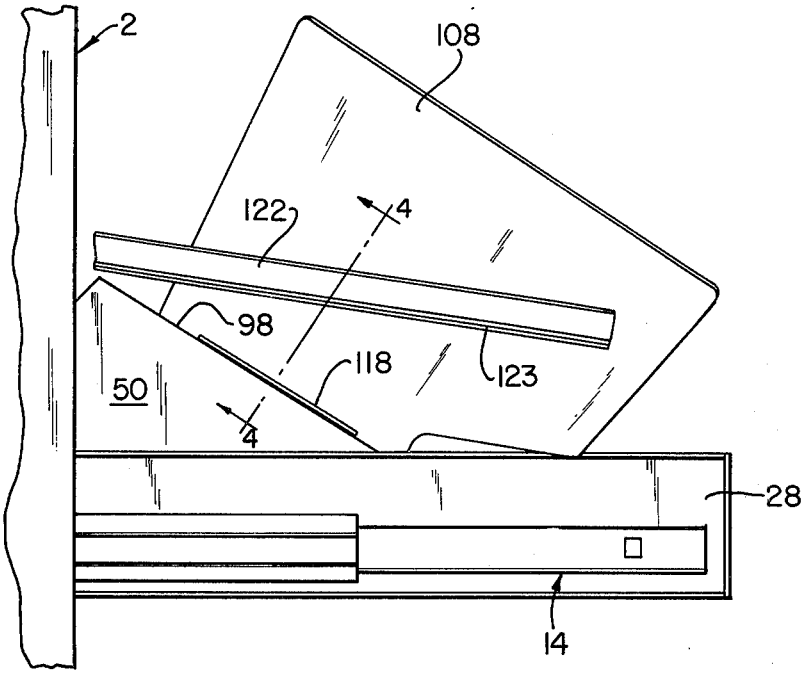
FIG. 2 is a side elevation of the same shelf unit.
Figure 3:
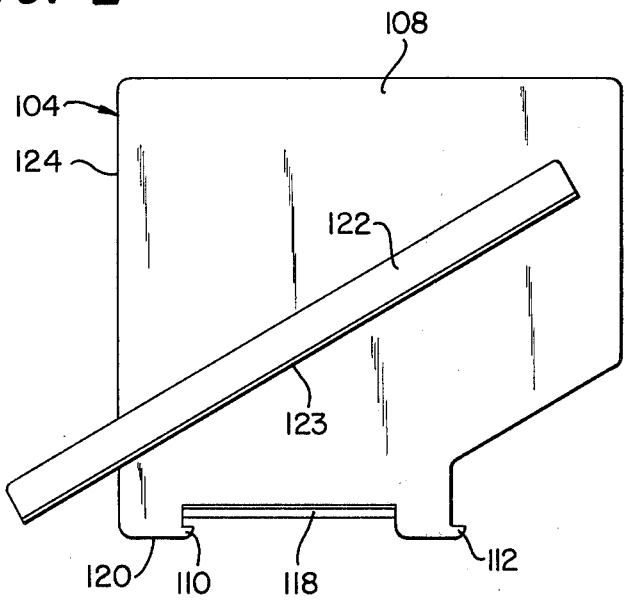
FIG. 3 is a side view of one of the book-closing means.

Book closing members 104 and 106 shift automatically to a more vertical position as the shelf is pushed back into the cabinet. This inward movement of the book closing members 104 and 106 is achieved by virtue of cooperating members carried by the book closing members and the cabinet. In this connection it is to be noted that an angle iron 122 of L-shaped cross section is affixed to the outer surface of each plate 108. As seen in FIGS. 2, 3 and 4, each angle iron 122 is secured so that it extends at an inclined angle with respect to hook sections 110 and 112 and also so that its rearward end projects beyond the rearward edge 124 of plate 108. Attached to each of cabinet side walls 6 and 8 is a channel member 126. Preferably each channel member is attached to the uprights in the same manner as suspension arm units 14. Thus each channel member 126 is formed with a pair of hook-like mounting tabs 127 which are punched out of its web section 128 and are adapted for interlocking with slots 22 of the adjacent uprights 16 and 18, whereby the channel member is releasably secured to and supported by the uprights. Attached to the upper flange 130 of each channel member 126 is at least one and preferably two stub shafts 132 and rotatably attached to each stub shaft is a roller 134. Channel members 126 are disposed so that their rollers 134 are slightly above the level of the right angle flanges 123 of angle irons 122 when book closing members 104 and 106 are in a vertical position. When book closing members 104 and 106 are in an open or inclined position (FIG. 1) and the shelf is pulled out of the cabinet, the rearward (inner) ends of the angle irons 122 are spaced from channel members 126 and the angle irons extend downwardly and outwardly away from the frontmost roller, (see FIGS. 1 and 2). When the shelf is pushed inwardly, the rearward ends of angle irons 122 are intercepted by the frontmost rollers 134, whereby the rollers act as cams and the angle irons act as cam follower to cause book closing members 104 and 106 to be cammed inwardly toward one another. As the shelf is moved back into the cabinet, angle irons 122 continue to run along rollers 134 and when the shelf is fully disposed within the cabinet, the book closing members 104 and 106 are vertical and the trailing end of angle irons 122 is engaged by the rearmost rollers 134. When the shelf is pulled out again to the position shown in FIG. 1, the book closing members 104 and 106 may or may not return to their inclined positions, depending upon the forces exerted thereon by the weight of the end volumes. In any event, when the user spreads open a selected book, the spreading apart of the pages of the volume will cause the endmost volumes to engage and force book closing members 104 and 106 into inclined positions shown in FIG. 1.

Obviously the cam mechanism whereby book closing members 104 and 106 are shifted to their vertical positions when the shelf is pushed back into the cabinet may be constructed otherwise than as shown. Thus, while the channel members 126 are preferably attached to uprights 16 and 18 by means of hook-shaped tabs in the same manner as the suspension arm units are attached to the uprights in U.S. Pat. No. 3,866,993, it is also to be appreciated that they may be secured in place by screws or other fasteners.

It is to be noted also that the book support plate 60 may be made in two or more sections so that any one of the sections may be removed from the shelf unit without disturbing the other sections. It is also contemplated that the cabinet may be provided with a keyed lock by which the shelves (and any other pull-out components) may be secured in a locked position. Such a key lock mechanism is described and illustrated in U.S. Pat. No. 3,404,929. Other forms of key lock mechanism also may be employed to perform the same function. It is also contemplated that the cabinet may include shelf interlock mechanisms which prevent more than one shelf from being pulled out at any one time and a door such as a self-storing tambour which can be closed to conceal the contents of the cabinet. Such features also are disclosed in U.S. Pat. No. 3,866,993.

It is to be understood also that the book closing mechanism of the present invention has utility and advantages even though means different than those herein described are used to mount the reference books or other volumes to the shelf units so that they may be opened and read without having to detach them from the shelf units.

Persons skilled in the art will also appreciate that the apparatus herein disclosed and illustrated may be modified in still other ways, such as by changing the shape and arrangement of parts or by substituting equivalent elements, without departing from the spirit and scope of the invention.

It is to be understood also that as used herein the term book is intended to denote a collection of information-bearing documents or pages attached to a holder or binder, and the book may or may not include front and/or back covers. By way of example but not limitation, all of the following are books for the purpose of this invention: catalogs, parts and other reference manuals, reports, computer printouts, and the like.

What is claimed is:

1. A filing cabinet containing at least one pull-out storage unit having opposite sides, means on said storage unit for supporting a plurality of books each including a binding portion, said books being supported in a reading position on said storage unit with said binding portions substantially aligned and facing downward, means coupled to said filing cabinet for selectively moving said storage unit between a retracted location within said cabinet and an accessible location outside thereof, said accessible location permitting said books to be opened and read in situ, said books retaining said reading position in both of said locations, and book-closing means interactive with said filing cabinet for causing any portions of said books projecting beyond either one of said opposite sides to be displaced inwardly of said storage unit when said storage unit is moved from said accessible location to said retracted location in said cabinet.

2. Apparatus according to claim 1 wherein said book-closing means comprises a pair of first members movably attached to respective ones of said opposite sides, a pair of second members attached to said cabinet at opposite ends thereof, each of said second members corresponding to one of said first members and being disposed to move said corresponding first member inwardly of said storage unit when said storage unit is moved from said accessible location to said retracted location.

3. Apparatus according to claim 2 wherein each of said first members is disposed so as to provide support for the pages of an open book in said accessible location when such pages project beyond said attached side.

4. Apparatus according to claim 2 wherein each of said first members is movable between a first position and a second position, each of said first members including a plate pivotably movable with respect to said attached side and projecting outward from said side in said first position, said first member being disposed within the boundaries of said storage unit in said second position.

5. Apparatus according to claim 4 wherein said first and second members have a cam follower-cam relationship.

6. Apparatus according to claim 4 wherein each of said second members includes at least a roller, each of said first members further including a guide rail fastened to a surface of said pivotably movable plate facing away from said storage unit, said roller being disposed so as to engage said guide rail of the corresponding first member to displace said first member as said storage unit is retracted into said cabinet.

7. Apparatus according to claim 1 wherein said means for supporting a plurality of books comprises a support plate, means for releasably attaching books to said support plate, said support plate being positioned so that said aligned binding portions face downward at an angle of inclination to the horizontal and the open pages of said books face upward at said angle, whereby said books may be opened without shifting out of said reading position.

8. Apparatus according to claim 6, wherein said guide rail extends beyond said plate to a point adjacent said roller when said corresponding first member is in said first position, said rail being positioned at an angle on said plate such that it remains in contact with said roller upon pivotal plate motion during movement of said storage unit between said locations.

* * * * *

UNITED STATES PATENT AND TRADEMARK OFFICE

CERTIFICATE OF CORRECTION

PATENT NO. : 4,037,895

DATED : July 26, 1977

INVENTOR(S) : Norman A. Hedstrom et als

It is certified that error appears in the above-identified patent and that said Letters Patent are hereby corrected as shown below:

Column 4, line 53 - Delete number "016" and substitute therefor "106"

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*